US005694905A

United States Patent [19]

Nuti

[11] Patent Number: 5,694,905

[45] Date of Patent: Dec. 9, 1997

[54] FUEL METERING ARRANGEMENT IN PNEUMATICALLY ASSISTED DIRECT FUEL INJECTION DEVICES

[75] Inventor: Marco Nuti, Pisa, Italy

[73] Assignee: Piaggio Veicoli Europei S.p.A., Pisa, Italy

[21] Appl. No.: 745,845

[22] Filed: Nov. 12, 1996

[30] Foreign Application Priority Data

Dec. 12, 1995 [IT] Italy ..... MI95A2594

[51] Int. Cl.[6] ..... F02M 67/02

[52] U.S. Cl. ..... 123/533

[58] Field of Search ..... 123/533, 531, 123/446

[56] References Cited

U.S. PATENT DOCUMENTS

| | | | |
|---|---|---|---|
| 2,710,600 | 6/1955 | Nallinger | 123/533 |
| 5,009,212 | 4/1991 | Bishai | 123/533 |
| 5,048,497 | 9/1991 | Kishida et al. | 123/533 |
| 5,069,189 | 12/1991 | Saito | 123/533 |
| 5,226,399 | 7/1993 | Ozawa | 123/533 |
| 5,271,372 | 12/1993 | Nuti | 123/533 |

FOREIGN PATENT DOCUMENTS

| | | | |
|---|---|---|---|
| 0246370 | 5/1986 | European Pat. Off. | 123/533 X |
| 0514982 | 5/1992 | European Pat. Off. | 123/533 |
| 929221 | 6/1946 | France | 123/533 X |
| 2222534 | 3/1974 | France | 123/533 X |

*Primary Examiner*—Raymond A. Nelli

*Attorney, Agent, or Firm*—Diller, Ramik & Wight, PC

[57] ABSTRACT

A fuel metering arrangement in devices for pneumatically assisted direct fuel injection into an internal combustion engine cylinder head (12) provided with a chamber (19) housing a connecting rod (23) for operating a compression piston (24) slidingly guided within a jacket (25) provided with one or more transfer conduits (26) connecting said internal chamber (19) to a variable-dimension space (27) positioned downstream of the piston (24) and upstream of a valve (28) providing access to a combustion chamber (29), fuel feed means (31, 33, 35) being connected to said variable-dimension space (27). In this manner a very rapid transient is achieved during acceleration.

9 Claims, 3 Drawing Sheets

FUEL METERING ARRANGEMENT IN PNEUMATICALLY ASSISTED DIRECT FUEL INJECTION DEVICES

BACKGROUND OF THE INVENTION

This invention relates to a fuel metering arrangement in pneumatically assisted direct fuel injection devices. Various pneumatically assisted direct injection devices have been produced for injecting fuel and air into the combustion chamber of controlled ignition engines, such as that of the patent EP-B-514982 of the present applicant.

In these types of devices the fuel is fed into an internal cylinder head chamber defined upstream of the piston, which acts to force the air-fuel mixture into the underlying cylinder. The present applicant has proposed various systems for this direct fuel injection. In a first system the fuel is fed through an appropriate conduit connected to said internal cylinder head chamber by way of a carburation system. A second system comprises an injector associated with said internal chamber with direct feed into it, or metering with an electromagnetic injector. Such devices operate satisfactorily and adequately, the mixture homogenization being achieved by utilizing lengthy passages formed by the particular arrangement of the constituent parts. In the case of road vehicle engines it has been found very important to achieve a transient which on the contrary is very rapid, particularly during acceleration.

The arrangement involved in the aforegoing systems is not always able to ensure the rapidity of this transient. This is because although on the one hand a lengthy passage favours mixture homogenization as stated, on the other hand a certain time is required, and this time, extending for example between deposition of most of the liquid on the chamber walls and then subsequent evaporation of this layer or film, can result in mixture insufficiency, and hence a lack of engine acceleration. Consequently an object of the present invention is to provide an arrangement which solves the aforesaid technical problem, in particular with fast engines for light road vehicles. A further object is to provide an arrangement which is particularly suitable for pneumatically assisted direct fuel injection devices.

SUMMARY OF THE INVENTION

These objects are attained according to the present invention by a fuel metering arrangement in devices for pneumatically assisted direct fuel injection into an internal combustion engine cylinder head provided with a chamber housing a connecting rod for operating a compression piston slidingly guided within a jacket provided with one or more transfer conduits connecting said internal chamber to a variable-dimension space positioned downstream of the piston and upstream of a valve providing access to a combustion chamber, characterised in that fuel feed means are connected to said variable-dimension space. The technical problem of previous devices is advantageously solved in this manner, with the achieving of a very rapid transient during the acceleration of road vehicle engines.

The characteristics and advantages of a fuel metering arrangement in pneumatically assisted direct fuel injection devices according to the present invention will be more apparent from the following description given by way of non-limiting example with reference to the accompanying schematic drawings, in which.

DESCRIPTION OF THE PREFERRED EMBODIMENTS

Figure 1:
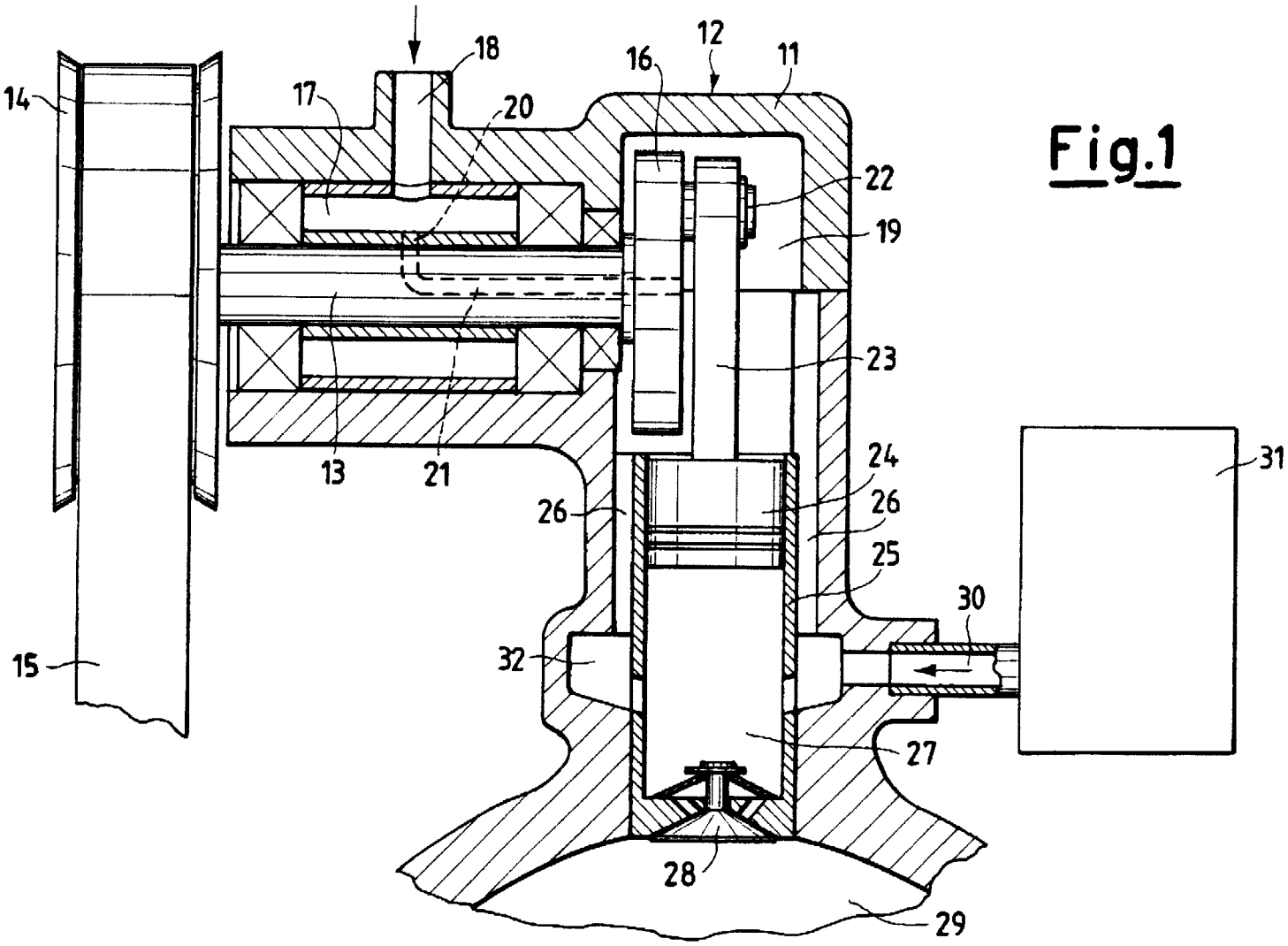
FIG. 1 is a schematic section through an upper portion of a cylinder head in which a first embodiment of a metering arrangement according to the present invention is provided.

From the figures it can be seen that in a removable portion 11 of an internal combustion engine cylinder head 12 there is provided a shaft 13 which by the action of a pulley 14 and relative belt 15 rotates a widened or flanged end 16 of the shaft 13. An entry conduit 18 for air plus oil or just oil in the embodiment shown in FIG. 1, or 18' for air plus oil in the embodiments shown in FIGS. 2 and 3 opens into a chamber-type housing 17 provided about the shaft 13. In various ways, for example as described in the preceding patent EP-B-514982 of the present applicant, the oil or the air plus oil pass into an internal chamber 19 housing the widened end 16 via a composite passageway indicated by dashed lines at 20 and 21. A first end of a connecting rod 23 connected to a piston 24 of a compression cylinder is eccentrically secured to the widened end 16 by a pin 22. The piston 24 is located within the compression cylinder jacket 25, about which there are provided, in lateral regions, one or more transfer conduits 26 which connect the internal chamber 19 upstream of the piston 24 to a variable-dimension space 27 downstream thereof and facing a valve (28), for example a popper valve, associated with a combustion chamber 29.

FIG. 1 shows a first embodiment of a mixture metering arrangement according to the invention.

At least one of the transfer conduits 26 is connected to a conduit 30 directly connected to a carburettor 31, which allows immediate mixture feed and entry. In this particular embodiment it can be seen that the conduit 30 feeds into an enlarged portion 32 which connects the transfer conduits 26 together.

Figure 2:
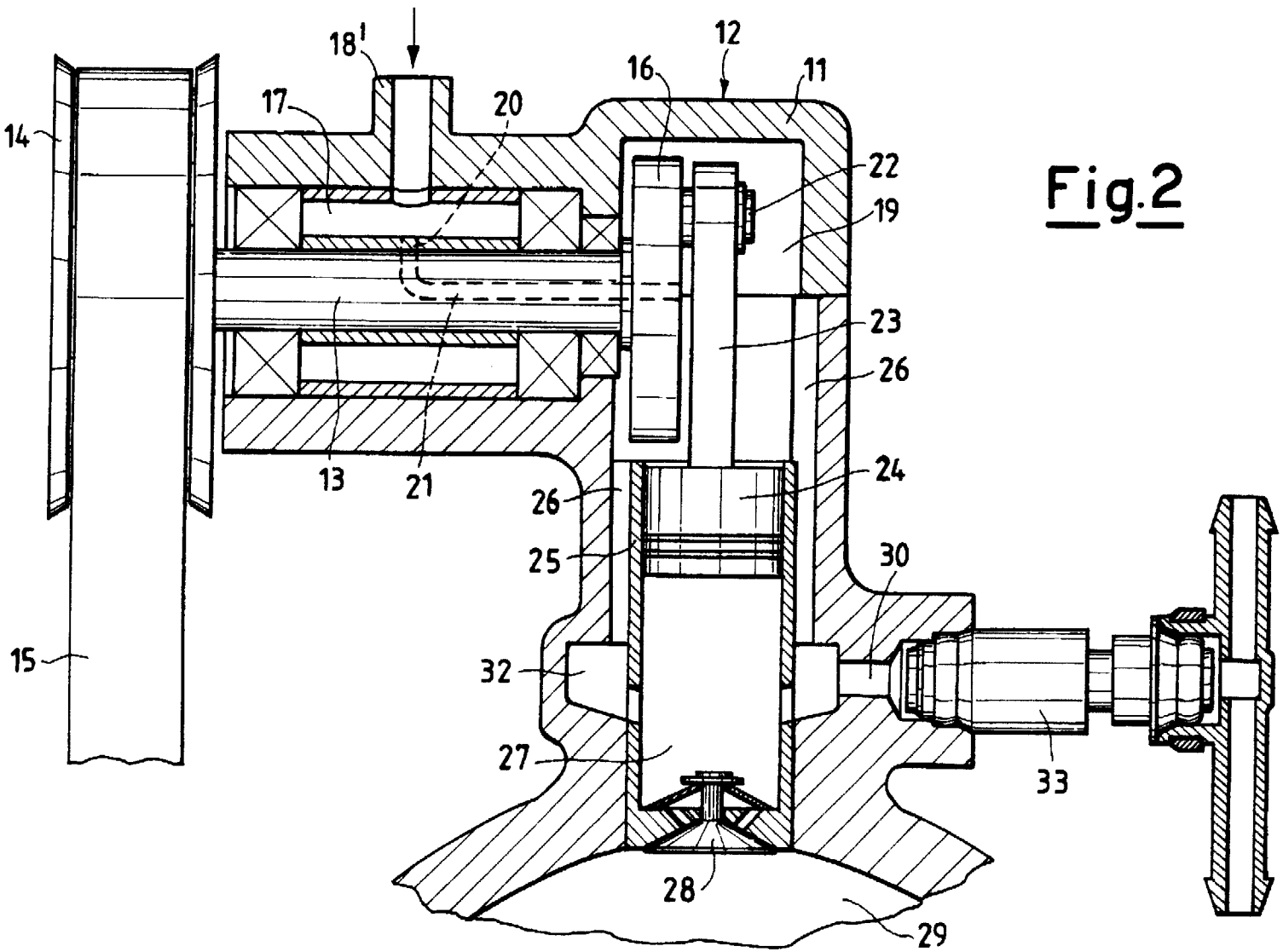
FIG. 2 is a schematic section through an upper portion of a cylinder head, similar to that of FIG. 1, in which a second embodiment of a metering arrangement according to the present invention is provided.

FIG. 2 shows a second embodiment of the arrangement of the invention, in which equal elements are indicated by the same reference numerals as the preceding.

In this embodiment the carburettor 31 is directly replaced by an electromagnetic injector 33, which is hence connected to at least one of the transfer conduits 26, or to the enlargement 32 connecting the transfer conduits 26 together, by means of the conduit 30, with a resultant rapid feed which prevents any possibility of a fall-off in engine acceleration.

Figure 3:
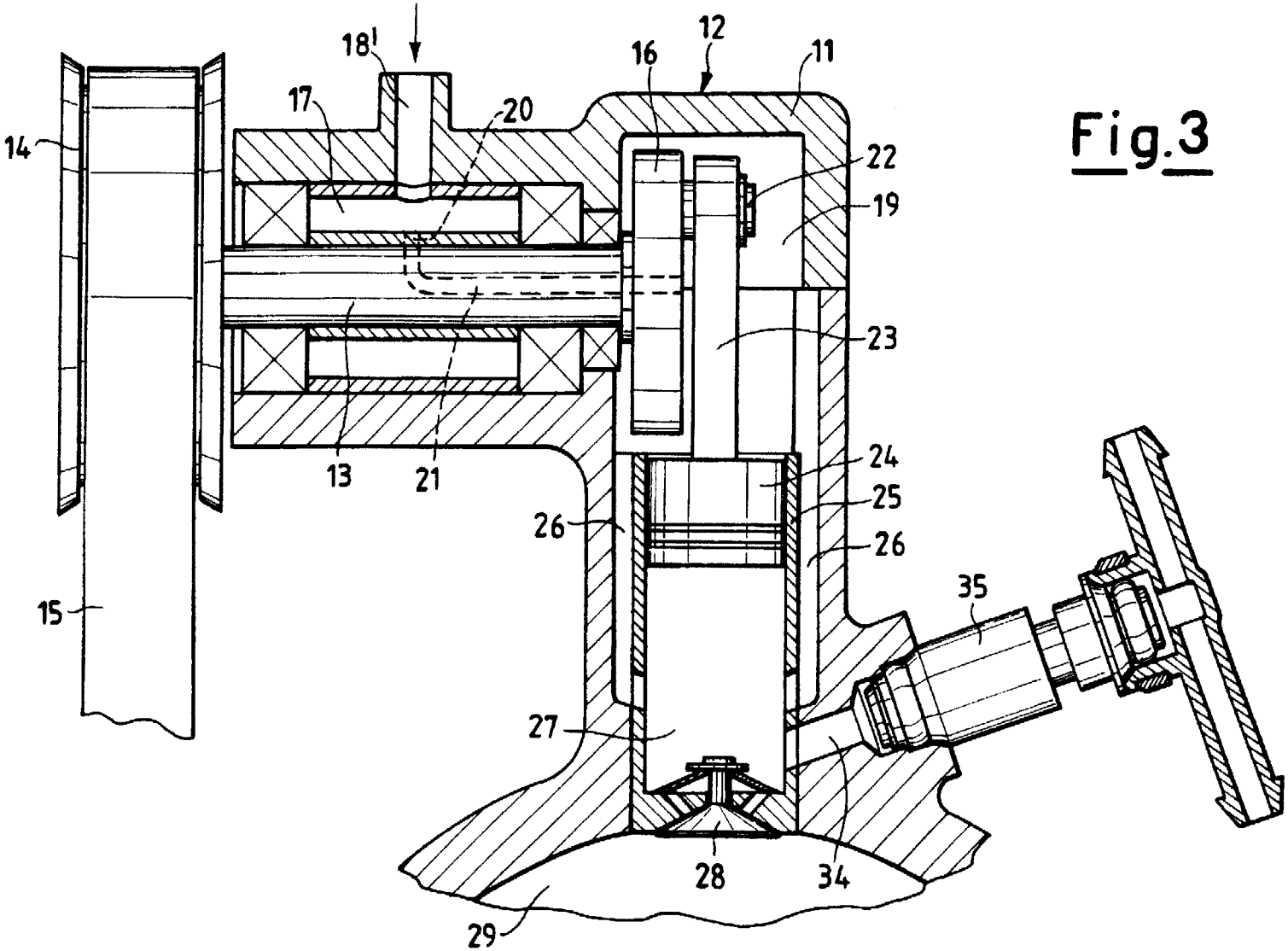
FIG. 3 is a schematic section through an upper portion of a cylinder head in which a third embodiment of a metering arrangement according to the present invention is provided.

FIG. 3 shows as third embodiment of the metering arrangement of the present invention, associated with a cylinder head provided with a pneumatically assisting device, and also using the same reference numerals as the preceding embodiments for equal elements.

It can be seen that the transfer conduits 26 open into the variable-dimension space 27 downstream of the piston 24, to the space 27 there being connected a conduit 34 directly connected to an electromagnetic injector 35.

The arrangement of the present invention hence achieves an extremely fast transient during engine acceleration. Specifically, in the embodiment of FIGS. 1 and 2 the mixture, originating from fuel feed means such as a carburettor or electromagnetic injector, is metered directly into at least one of the transfer conduits 26 or into an enlargement 32 which connects them together below the compression piston 24 prior to the space 27. In the other embodiment (FIG. 3) the mixture is directly introduced by a further fuel feed means, ie the electromagnetic injector 35, into the space 27 downstream of the compression piston 24 acting as a pump, and downstream of the transfer conduits 26.

Although a preferred embodiment of the invention has been specifically illustrated and described herein, it is to be understood that minor variations may be made in the apparatus without departing from the spirit and scope of the invention, as defined the appended claims.

I claim:

1. A fuel metering arrangement in devices for pneumatically assisted direct fuel injection into an internal combustion engine cylinder head (12) provided with a chamber (19) housing a connecting rod (23) for operating a compression piston (24) slidingly guided within a jacket (25) provided with one or more transfer conduits (26) connecting said internal chamber (19) to a variable-dimension space (27) positioned downstream of the piston and upstream of a valve (28) providing access to a combustion chamber (29), characterised in that-fuel feed means (31, 33, 35) are connected to the variable-dimension space (27) downstream of said piston (24).

2. An arrangement as claimed in claim 1, characterised in that said fuel feed means connected to the space (27) downstream of said piston (24) are an electromagnetic injector (33, 35).

3. An arrangement as claimed in claim 1, characterised in that said fuel feed means connected to the space (27) downstream of said piston (24) are a carburettor (31).

4. An arrangement as claimed in claim 1, characterised in that said fuel feed means are connected to the space (27) downstream of said piston (24) by conduits (30, 34).

5. An arrangement as claimed in claim 1, characterised in that said fuel feed means are connected directly to the space (27) downstream of said piston (24).

6. An arrangement as claimed in claim 1, characterised in that said fuel feed means are connected to a portion of at least one of said transfer conduits (26).

7. An arrangement as claimed in claim 6, characterised in that said fuel feed means are connected to an enlargement (32) connecting said transfer conduits (26) to the space (27) downstream of said piston (24).

8. An arrangement as claimed in claim 2, characterised in that said fuel feed means are connected to the space (27) downstream of said piston (24) by conduits (30, 34).

9. An arrangement as claimed in claim 3, characterised in that said fuel feed means are connected to the space (27) downstream of said piston (24) by conduits (30, 34).

* * * * *